US005513611A

United States Patent [19]

Ricouard

[11] Patent Number: 5,513,611

[45] Date of Patent: May 7, 1996

[54] THROTTLE CONTROL SYSTEM WITH MOTOR LINKAGE AND POSITION CONTROL

[75] Inventor: Jean-Pierre Ricouard, Eragny Sur Oise, France

[73] Assignee: Societe D'Applications Generales D'Electricite et de Mecanique (Sagem), Paris, France

[21] Appl. No.: 277,381

[22] Filed: Jul. 19, 1994

[30] Foreign Application Priority Data

Jul. 22, 1993 [FR] France ..... 93 09011

[51] Int. Cl.[6] ..... F02D 7/00

[52] U.S. Cl. ..... 123/399; 123/361

[58] Field of Search ..... 123/399, 396, 123/350, 352, 361, 403; 477/107; 180/179, 178

[56] References Cited

U.S. PATENT DOCUMENTS

| | | | |
|---|---|---|---|
| 4,724,811 | 2/1988 | Maisch | 123/361 |
| 5,131,364 | 7/1992 | Mann | 123/390 |
| 5,161,507 | 11/1992 | Terazawa et al. | 123/399 |
| 5,209,207 | 5/1993 | Shitani et al. | 123/399 |
| 5,320,076 | 6/1994 | Reppich et al. | 123/396 |
| 5,345,907 | 9/1994 | Matsuoka | 123/399 |
| 5,366,424 | 11/1994 | Wataya | 477/107 |
| 5,367,997 | 11/1994 | Kawamura et al. | 123/399 |
| 5,383,431 | 1/1995 | Nishimura et al. | 123/399 |

FOREIGN PATENT DOCUMENTS

| | | | |
|---|---|---|---|
| 0271030 | 6/1988 | European Pat. Off. | H02K 37/42 |
| 2599805 | 12/1987 | France | F02D 9/02 |
| 4027269 | 3/1992 | Germany | F02D 9/08 |

OTHER PUBLICATIONS

Preliminary Search Report, dated Nov. 3, 1993, French Patent Office.

*Primary Examiner*—Raymond A. Nelli
*Attorney, Agent, or Firm*—Quarles & Brady

[57] ABSTRACT

A throttle control system includes a pedal (10) and a mechanical linkage (11, 12, 13) to a casing (6). Stepper motor (5) has a stator mounted on the casing (6), so that as the casing (6) is rotated, it will also move the stator of the stepper motor (5). Stepper motor (5) also controls the position of a shaft (4) which carries a butterfly valve (1) regulating the fuel flow in an internal combustion engine. Position sensor (8) senses angular changes of position between casing (6) and shaft (4). Position changes in shaft (4) resulting from operation of pedal (10) and linkage (11, 12, 13) are signalled to microprocessor (7) which operates motor (5) to provide corrective rotation of shaft (4).

6 Claims, 2 Drawing Sheets

THROTTLE CONTROL SYSTEM WITH MOTOR LINKAGE AND POSITION CONTROL

BACKGROUND OF THE INVENTION

1. Field of the Invention

The present invention concerns a system for supplying a vehicle internal combustion engine with fuel, comprising, in an inlet manifold, an inlet butterfly valve mounted so as to move under the action of a mechanical control device and fixed so as to move with the shaft of a movement regulating motor, the motor being fixed so as to move with the control device.

2. Description of the Background Art

In the case of a petrol engine, the speed of the motor is notably determined by the accelerator pedal, which acts on the inlet butterfly valve.

In order to function optimally, so as not to stall or cause excessive pollution, the engine must be supplied with a mixture of air and petrol at the required rate, remaining within well-defined proportions.

However, at throttle down, switching on an electrical appliance, such as an air conditioner, puts a sudden load on the engine, which may stall. In order to remedy this, it is known that an additional air inlet circuit can be provided. A computer for monitoring the engine speed controls, by means of a stepping motor, a needle regulating the additional circuit and prevents stalling by means of the corresponding input of air.

The document FR-A-2 599 805 discloses a supply system of the type mentioned above in which the shaft of the motor is fixed to the butterfly valve with respect to rotation and the associated stator is mounted so as to rotate and is driven by an accelerator pedal.

However, if the accelerator pedal is depressed or released abruptly, the engine is not able to function optimally. The present invention aims to resolve this problem.

To this end, the supply system of the invention is characterised in that a microprocessor is arranged so as to measure the movement of the regulating motor with respect to an idle position and to demand the rotation of its shaft according to the said movement.

Thus any movement of the control device which would cause the motor to leave its optimum range of functioning is compensated for by the action of the regulating motor, and a mechanical excessive-acceleration command is transmitted to the regulating motor in an integrated form, that is to say spread over time.

Advantageously, the microprocessor is arranged so as, in response to a movement of the control device, to limit the speed of movement of the shaft and to demand, if suck is the case, a complementary progressive movement of the latter.

BRIEF DESCRIPTION OF THE DRAWINGS

The invention will be better understood by means of the following description of the preferred embodiment of the supply system of the invention, with reference to the accompanying drawing in which.

DETAILED DESCRIPTION OF THE PREFERRED EMBODIMENT

Figure 1:
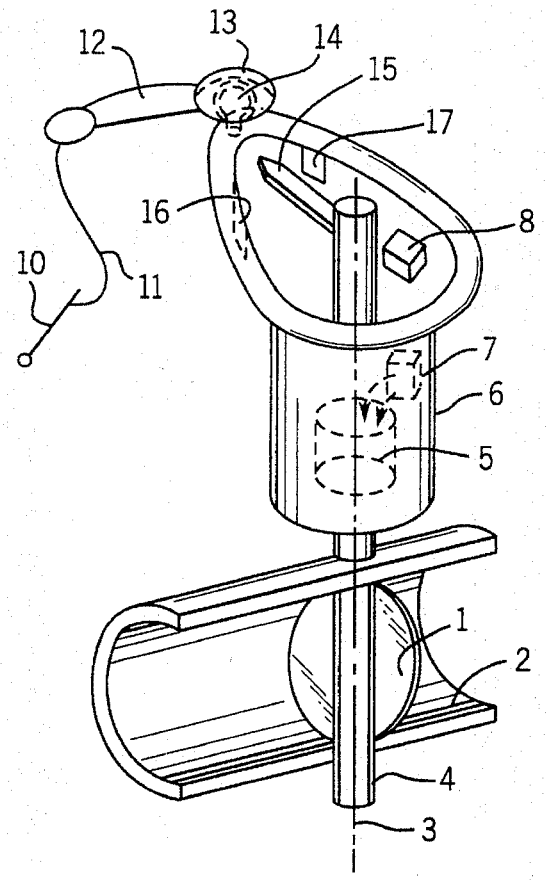
FIG. 1 is an exploded perspective view of the device of the invention.

The supply system shown in FIG. 1 is in this case mounted on the internal combustion engine of a car and includes a butterfly valve 1 mounted so as to move, in this case in rotation, in the air inlet manifold 2 of a carburetor (not shown). The butterfly valve 1 is fixed, so as to rotate on an axis 3, to the shaft 4 of a motor 5, in this example a stepping motor, housed in a casing 6 with a microprocessor 7 which controls it and with an angular movement sensor 8.

The shaft 4 is carried respectively at its two ends by two bearings (not shown) fixed to the manifold 2 and carries the casing 6, leaving it free to rotate about the shaft 4.

The movement sensor 8 cyclically determines the angular position of the casing 6 with respect to the manifold 2 and transmits a corresponding signal to the microprocessor 7.

A cable 11 connects an accelerator pedal 10 to one end of a connecting rod 12, the other end of which has a hollow spherical cap fitted to a spherical stud 14, off center with respect to the axis 3 of the casing 6.

To the shaft 4 of the stepping motor 5 is fixed a radial pointer 15 moving between two stops 16–17 on the casing 6 and thus limiting the range P (FIG. 3) of angular rotation of the shaft 4 with respect to the casing 6.

The functioning of the supply system of the invention will now be described.

Figure 4:
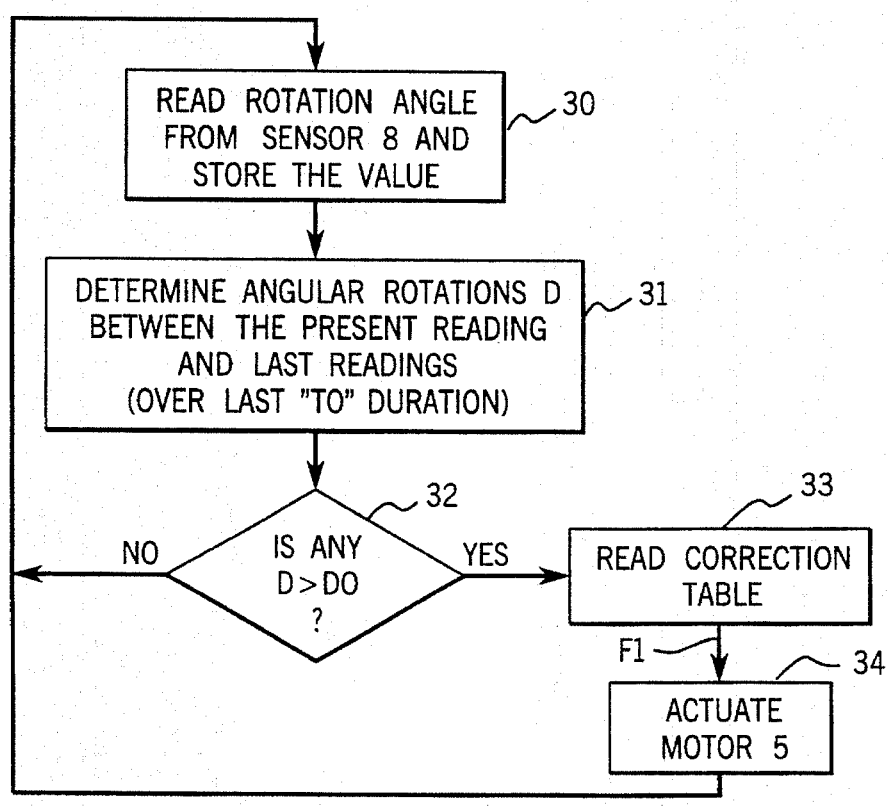
FIG. 4 illustrates a flow chart of a relevant portion of operation of the microprocessor.
Figure 2:
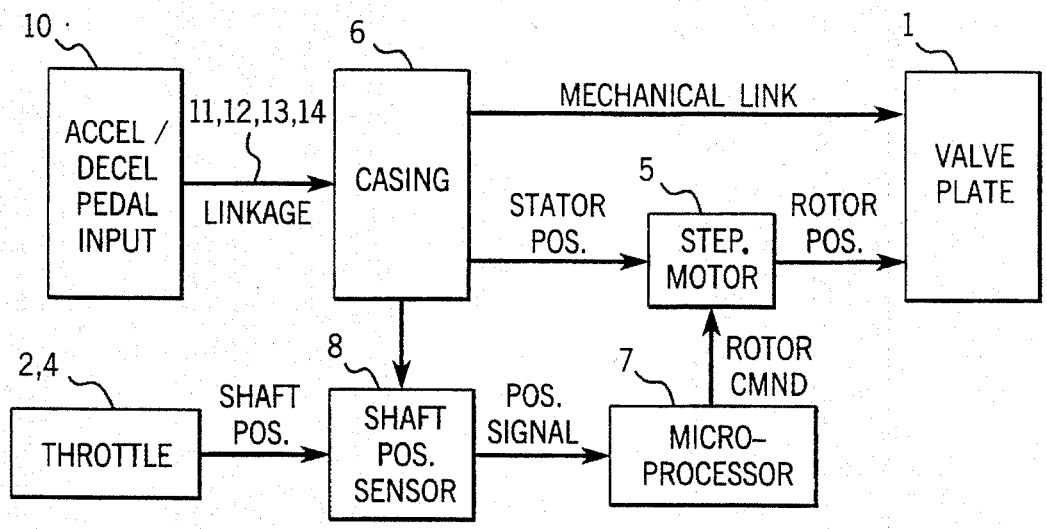
FIG. 2 is a functional diagram explaining the functioning.

As is shown by the diagram in FIG. 2, the accelerator pedal 10 directly rotates the casing 6, as represented by process block 30 in FIG. 4. The corresponding rotation with respect to the manifold 2 is measured by the sensor 8 and the series of corresponding measurement signals enables the microprocessor 7 to determine the extent and speed of this rotation, as represented by process block 31 in FIG. 4.

The microprocessor 7 has a threshold value stored in memory, corresponding to a maximum permissible value DO (FIG. 3) of angular variation in the position of the butterfly valve 1 over a given time TO, a fraction of a second, and compares this value cyclically with the measured angle of rotation of the casing 6, as represented by decision block 32 in FIG. 4. The microprocessor 7 then actuates the stepping motor 5 if the angular variation exceeds the threshold value DO over a period of time less than the period TO, that is to say if it has a significant extent and excessive speed, as represented by process blocks 33 and 34 in FIG. 4.

Figure 3:
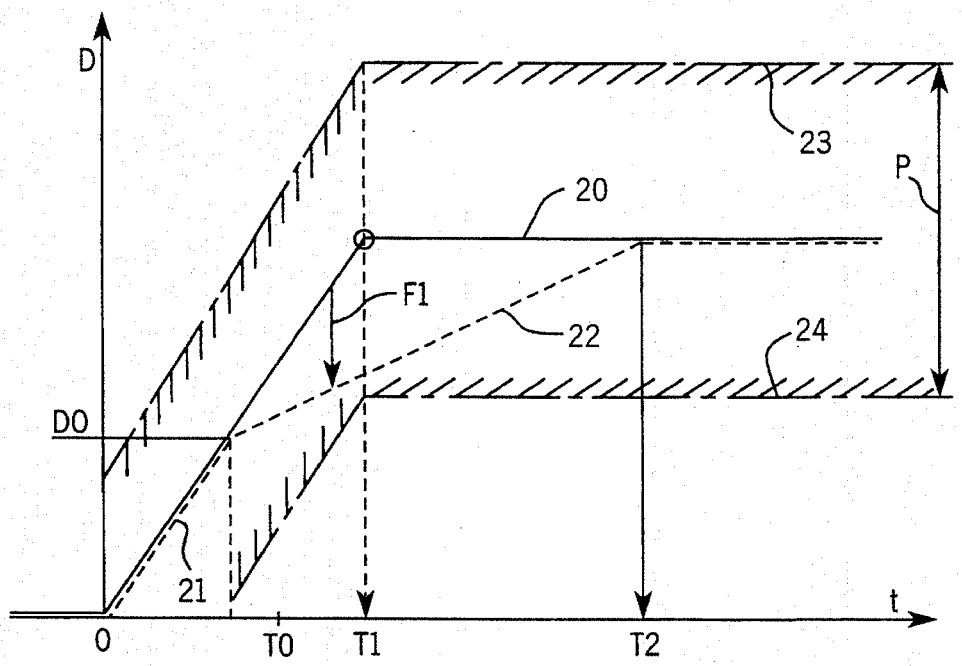
FIG. 3 illustrates the law regulating the angular deflection of the butterfly valve.

As is shown in FIG. 3, where the line 20 represents the angular movement D of the casing 6 as a function of time t, with an origin of the angles arbitrarily fixed at zero for an initial idle position, the angular position 21 of the butterfly valve 1 is merged with the line 20 as long as the angular movement 20 of the casing 6 is less than the threshold DO. After the start of the variation in the angle D for the line 20, this threshold is in this case exceeded after a period less than the period T0, so that the microprocessor 7 then actuates the stepping motor 5 in order to cause its shaft 4 to rotate in the opposite direction to the casing 6 (arrow F1), so that the rotation on the butterfly valve 1 follows a line 22 having a slope less than that of the line 20 in its variable part, until it later rejoins the line 20.

The lines 23 and 24, parallel to the line 20 and in this case at equal distances from the latter, delimit the range P of regulation of the motor 5, defined by the stops 16, 17. The line 22 is always within this range P, though it may temporarily follow one edge thereof and may not optimally correct the deflection of the butterfly valve 1 if the correction to be made exceeds half of this range P.

Knowing the absolute position of the butterfly valve 1 in the manifold 2 and the strength of the mechanical control coming from the pedal 10, it will be understood that it is possible to store tables of values or algorithms in the microprocessor 7, enabling the speed of rotation of the butterfly valve 1 to be adapted optimally.

Among other things, provision can be made to modify the value of the angular threshold DO, of the time TO and of the slope of the line 22 according to the initial absolute position of the butterfly valve 1 and, for example, to allow a more rapid rotation when the butterfly valve 1 is already in the position where the manifold 2 is half open, and therefore with a car engine rotating at a steady speed and thus better able to accelerate.

Conversely, the absolute angular position sensor 8 could be replaced with a relative movement detector, such as an acceleration meter, from the measurements of which the microprocessor 7 would determine relative rotations.

It will be understood that the components of the supply system could have movements other than rotary ones.

I claim:

1. A throttle control system for controlling the supply of fuel to a vehicle internal combustion engine through an inlet manifold (2), said system comprising:

an inlet butterfly valve (1) positioned in said inlet manifold (20);

a motor (5) having a stator and a shaft that extends from the stator to carry the butterfly valve (1); said shaft being rotatable with respect to said stator;

a mechanical linkage including a portion on which said stator is mounted, such linkage being movable in response to an acceleration/deceleration input to move said stator with respect to said;

a position sensor for sensing position of the shaft relative to said stator; and a microprocessor (7) electrically connected to said sensor to receive signals indicating the position of said shaft with respect to said stator, said microprocessor (17) comparing the indicated position with stored values,, and in response thereto commanding rotation of the shaft (4).

2. A throttle control system according to claim 1, wherein the microprocessor (7) limits the speed of movement of the shaft (4).

3. The throttle control system according to claim 1, in which movement of the shaft under control of the microprocessor is in a direction counter to the movement of the shaft as a result of movement of the stator in response to movement of the control linkage.

4. A throttle control system according to claims 1, 2 or 3, wherein said portion of the mechanical linkage on which said stator is mounted includes a travel limiting pointer (15) mounted to move with the shaft (4) and two stops (16, 17) fixedly connected to the stator, said travel limiting pointer moving between said two stops (16.17).

5. A throttle control system according to claims 1; 2; 3, or 4 in which the motor (5) has a shaft for rotation at a controlled speed.

6. A throttle control system according to claims 1, 2, 3, or 4 in which the regulating motor (5) is a stepping motor.

* * * * *

UNITED STATES PATENT AND TRADEMARK OFFICE

CERTIFICATE OF CORRECTION

PATENT NO. : 5,513,611

DATED : May 7, 1996

INVENTOR(S) : Ricouard, Jean-Pierre

It is certified that error appears in the above-identified patent and that said Letters Patent is hereby corrected as shown below:

Column 1, line 54, "suck" should be --such--.

Column 2, line 62, "T0" should be --TO--.

Column 3, line 33, "(20)" should be --(2)--.

Column 4, line 4, after "said" --shaft-- should be inserted.

Column 4, line 10, the second comma should be deleted.

Column 4, line 30, "." should be --,--.

Column 4, line 31, ";" should be "," in both appearances.

Signed and Sealed this

Twenty-seventh Day of August, 1996

Bruce Lehman

*Attest:*

BRUCE LEHMAN

*Attesting Officer*

*Commissioner of Patents and Trademarks*